US010414545B2

(12) United States Patent
Liu

(10) Patent No.: US 10,414,545 B2
(45) Date of Patent: Sep. 17, 2019

(54) CUP

(71) Applicant: Chang Hsien Liu, Taoyuan (TW)

(72) Inventor: Chang Hsien Liu, Taoyuan (TW)

( * ) Notice: Subject to any disclaimer, the term of this patent is extended or adjusted under 35 U.S.C. 154(b) by 0 days.

(21) Appl. No.: 14/686,934

(22) Filed: Apr. 15, 2015

(65) Prior Publication Data

US 2016/0236816 A1 Aug. 18, 2016

(30) Foreign Application Priority Data

Feb. 16, 2015 (TW) ..... 104202599 U

(51) Int. Cl.
*B65D 21/02* (2006.01)
*A47G 19/22* (2006.01)
*A47G 19/23* (2006.01)

(52) U.S. Cl.
CPC ..... *B65D 21/023* (2013.01); *A47G 19/2255* (2013.01); *A47G 19/23* (2013.01); *B65D 21/0213* (2013.01)

(58) Field of Classification Search
CPC ..... B65D 21/0209; B65D 21/0212; B65D 21/0216; A47G 19/23; A47G 23/0216
USPC ..... 206/503
See application file for complete search history.

(56) References Cited

U.S. PATENT DOCUMENTS 1,666,389 A * 4/1928 Mander ..... A47G 19/23 220/23.86
2,664,004 A * 12/1953 Sol Forman ..... A47G 19/2255 215/377
3,721,361 A * 3/1973 Barry ..... B65D 43/0229 215/302
4,082,200 A * 4/1978 Guest ..... B65D 23/001 215/12.1
5,108,768 A * 4/1992 So ..... B65D 85/8043 206/519
6,299,007 B1 * 10/2001 Takeuchi ..... B65D 1/0276 215/371
7,886,924 B2 * 2/2011 Willat ..... A47G 19/2205 215/379
2006/0131309 A1 * 6/2006 Listenberger ..... A47G 19/2272 220/500
2013/0334166 A1 * 12/2013 Garipalli ..... A47G 19/2205 215/377

* cited by examiner

*Primary Examiner* — Andrew T Kirsch

(74) *Attorney, Agent, or Firm* — Tommy S F Wang; Wang IP Law Group, P.C.

(57) ABSTRACT

A cup includes a body being hollowed. The body defines a receiving cavity therein. An opening of the receiving cavity is faced upward when the body is standing. A flange is defined around the opening and protruded inward. The body defines an annular groove formed around the same height of the body and recessed inward the body. The diameter of an upper portion above the annular groove is greater than the diameter of the opening, and the diameter of a lower portion below the annular groove is less than the diameter of the opening. When two cups are to be stacked with each other, the lower portion of the body of one cup is placed into the opening of the body of the other cup, and the flange of the body of the other cup is engaged with the annular groove of the body of one cup.

2 Claims, 13 Drawing Sheets

CUP

BACKGROUND OF THE INVENTION

Field of the Invention

The present invention relates to a cup, and more particularly to a stackable and combinable cup.

Description of the Prior Art

A typical cup includes a body defining a receiving cavity therein, so that a user can drink the water of the beverage in the receiving cavity by using his/her mouth to contact the flange of the cup. When the cup is not in use, the cup may be stacked with other cups for space saving.

As shown in FIG. 11, illustrating a conventional cup in which the diameter of the opening 92 of the body 91 is greater than the bottom portion 93 of the body 91. For storage, the bottom portion 93 of the body 91 of one cup is placed into the opening 92 of the other cup. These cups can be stacked with each other stably because of a larger overlapping area there between.

And, in FIG. 12, another conventional cup is illustrated. The cup includes a body 94 defines an opening 95, and the outer diameter of the body 94 is uniform along a longitudinal direction of the body 94 except the bottom portion 96 of the body 94. The outer diameter of the bottom portion 96 is gradually reduced. Therefore, for storage, the bottom portion 96 of the body 94 of one cup is placed into the opening 95 of the other cup. Although the cup is not very tall, the portion of the bottom portion 96 to be placed into the other cup is not enough to allow the cups to be stacked stably.

In FIG. 13, yet another conventional cup is illustrated. The cup includes a body 97 defines an opening 98. The outer diameter of the middle portion of the body 97 is greater than the outer diameters of the top and bottom portions of the body 97, and the outer diameter of the opening 98 is slightly greater than that of the bottom portion 99. For storage, the bottom portion 99 of the body 97 of one cup is placed into the opening 98 of the other cup. However, the cup is tall, and the portion of the bottom portion 99 to be placed into the other cup is not enough to allow the cups to be stacked stably. Moreover, among the three different kinds of typical cups, the cups shown in FIG. 13 is the least stable when stacking one another. The present invention is, therefore, arisen to obviate or at least mitigate the above mentioned disadvantages.

SUMMARY OF THE INVENTION

One object of the present invention is to provide a cup which can be stacked and combined stably one another.

A further object of the present invention is to provide a cup and a cup foot and combine the cup and the cup foot as a goblet, such that the appearance of the cup can be changed.

To achieve the above and other objects, a cup is provided and comprises a body being hollowed. The body defines a receiving cavity therein. An opening of the receiving cavity is faced upward when the body is standing. A flange is defined around the opening and protruded inward. The body defines an annular groove formed around the same height of the body and recessed inward the body. The diameter of an upper portion above the annular groove is greater than the diameter of the opening, and the diameter of a lower portion below the annular groove is less than the diameter of the opening. When two cups are to be stacked with each other, the lower portion of the body of one cup is placed into the opening of the body of the other cup, and the flange of the body of the other cup is engaged with the annular groove of the body of one cup.

In some implementation aspects, the annular groove is defined at the bottom portion of the body, and the outer diameter of the body is gradually reduced from the upper portion above the annular groove toward the lower portion below the annular groove.

In some implementation aspects, the present invention further comprises a cup foot having a foot portion. The top of the foot portion has a base portion, and the base portion is recessed inward and defines a base opening. A base flange is defined around the base opening, and the structure of the base opening and the base flange are the same as the structure of the opening and the flange. When the cup is to be combined with the cup foot, the lower portion of the body is placed into the base opening of the base portion, and the base flange of the base portion is engaged with the annular groove of the body.

In some implementation aspects, the annular groove is defined around a waist portion of the body, and the outer diameter of the body is gradually reduced from the upper portion above the annular groove toward the lower portion below the annular groove.

In some implementation aspects, the body is made of Polyethylene terephthalate.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIG. 1 to FIG. 10, illustrating exemplary embodiments according to the present invention. The embodiments are provided for illustrative purposes, and the claimed scope of the present invention is not limited thereto.

Figure 1:
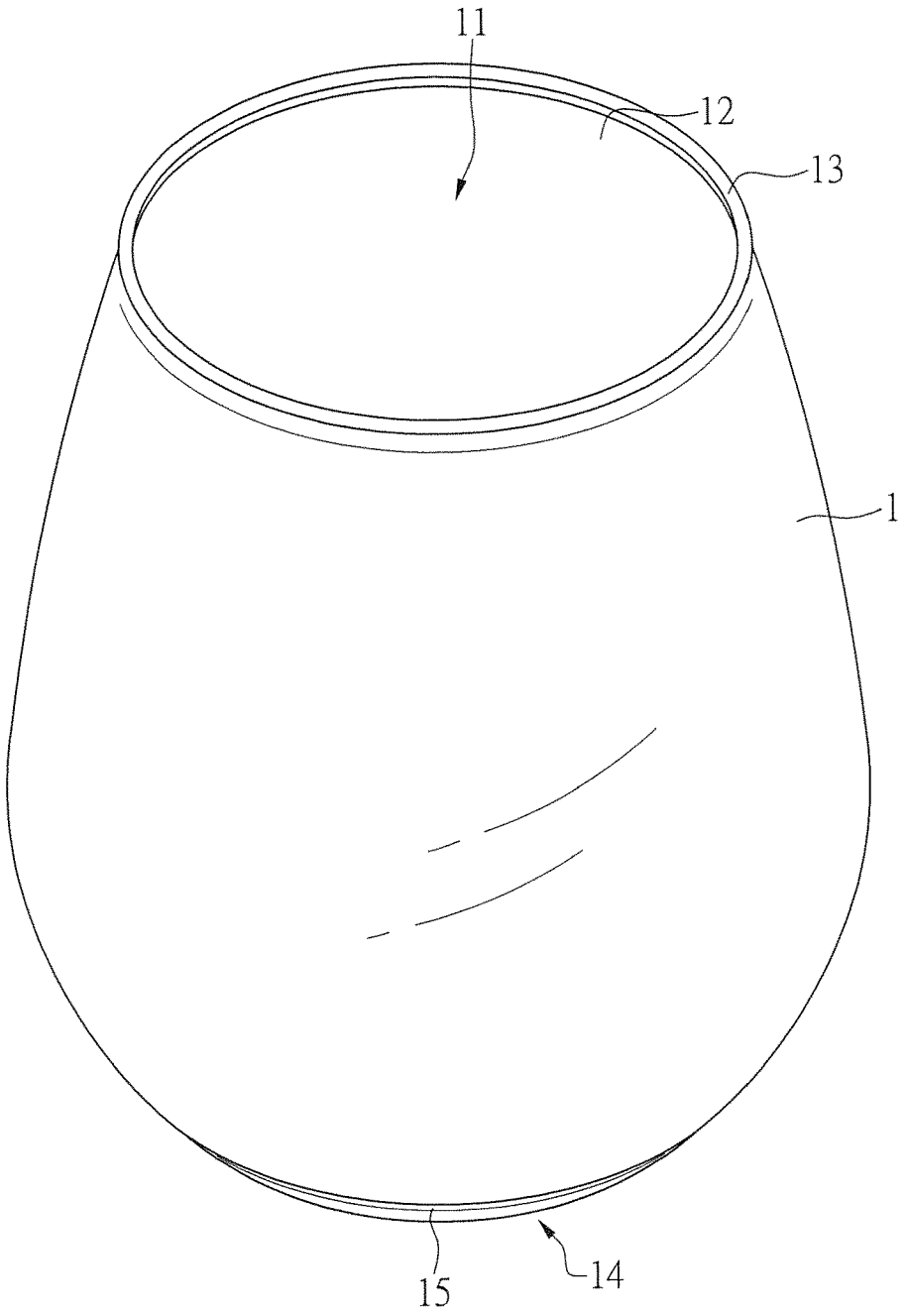
FIG. 1 illustrates a perspective view of a first embodiment of a cup according to the present invention.
Figure 2:
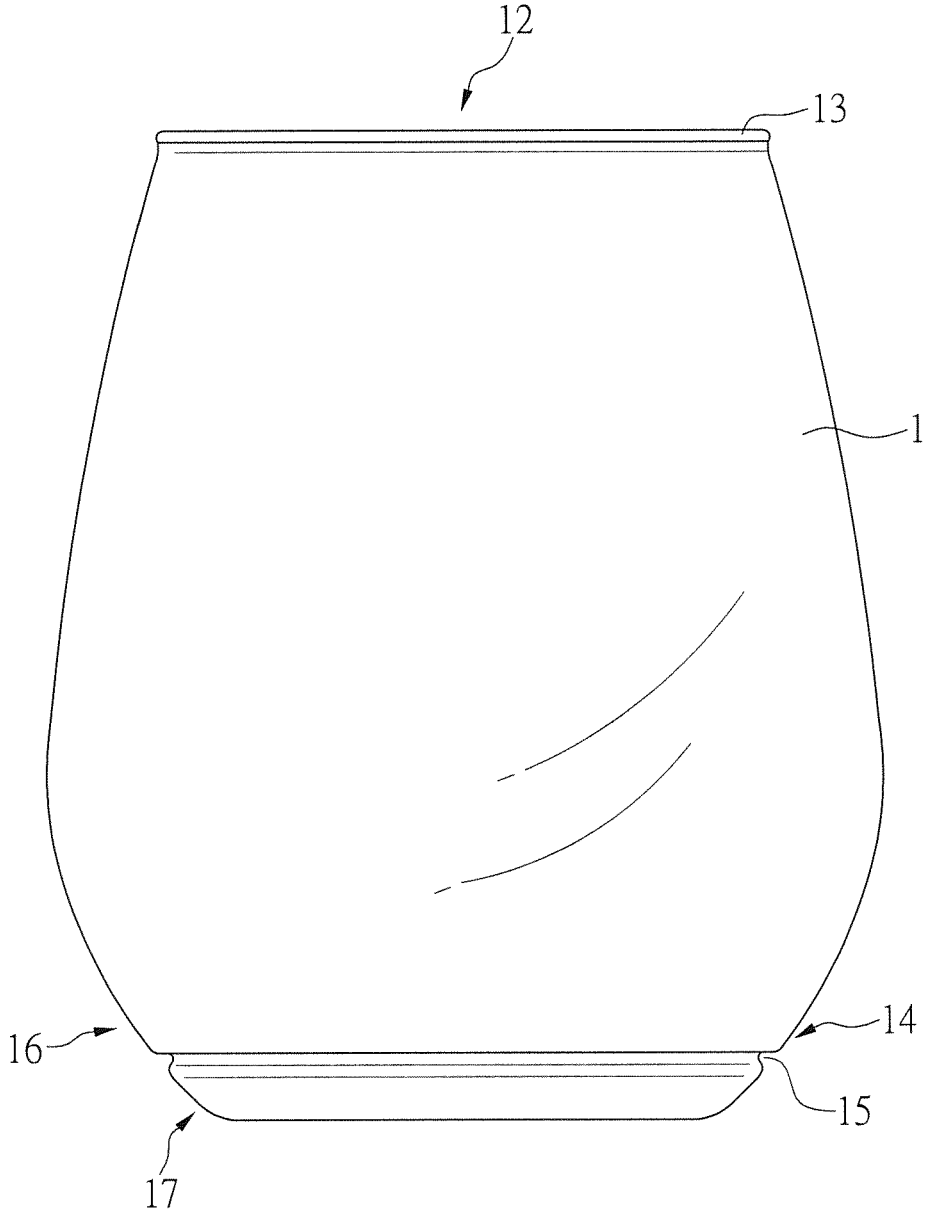
FIG. 2 illustrates a lateral view of the cup shown in FIG. 1.
Figure 3:
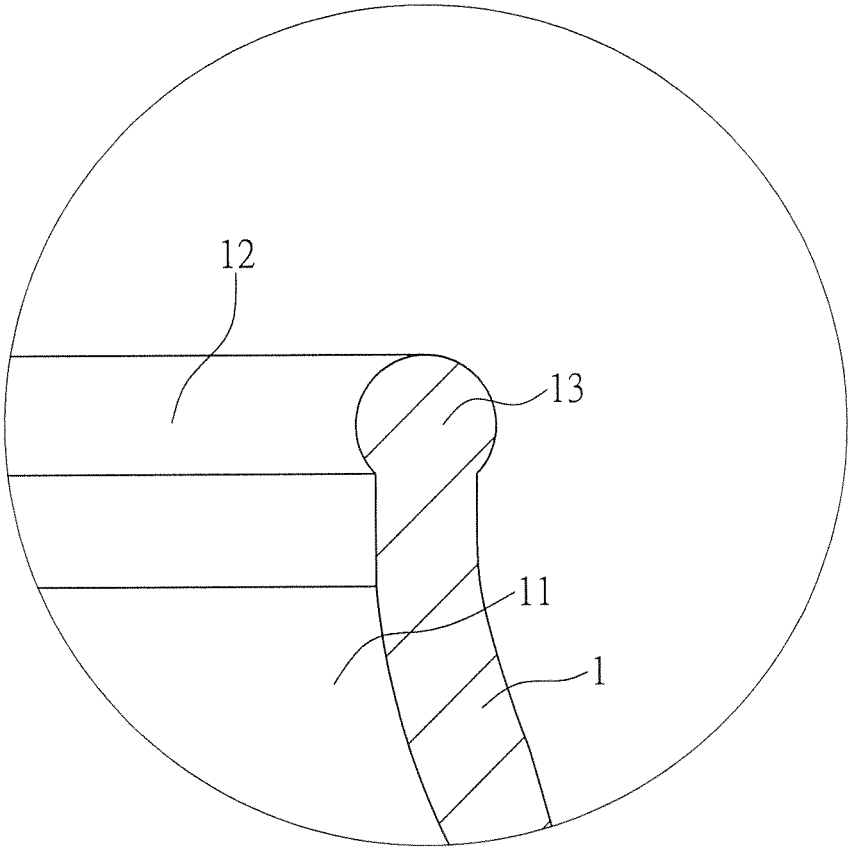
FIG. 3 is a partial enlarged view illustrating the flange of the body of the cup in the first embodiment.
Figure 4:
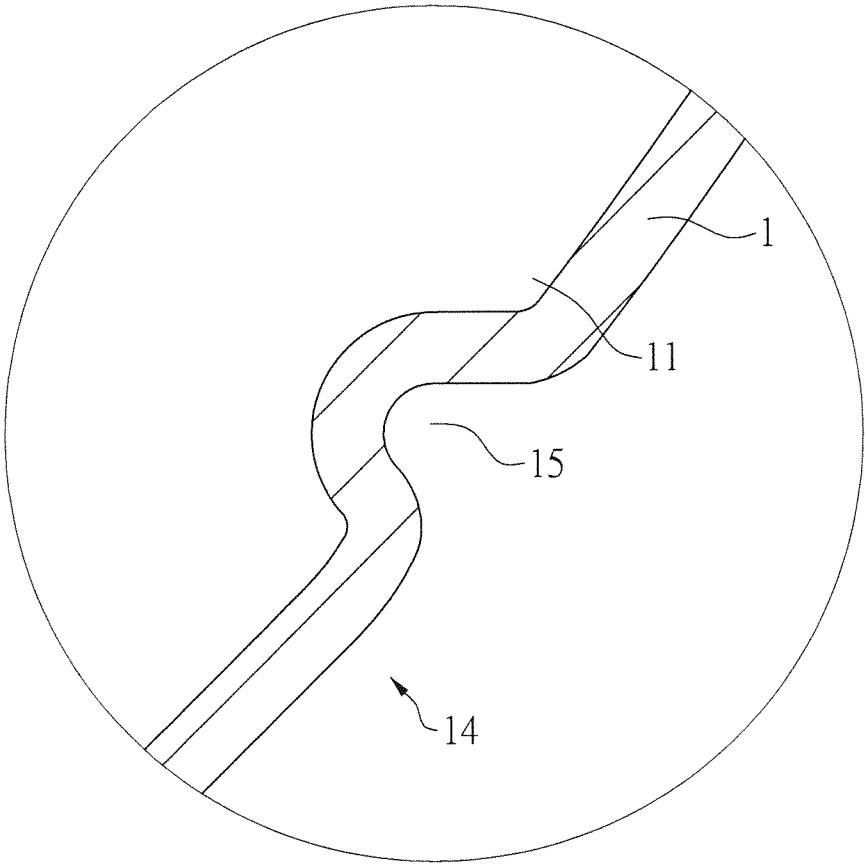
FIG. 4 is a partial enlarged view illustrating the annular groove of the body of the cup in the first embodiment.

Please refer to FIG. 1 and FIG. 2, illustrating a first exemplary embodiment of a cup according to the present invention. The cup is a wine cup and has a body 1. The body 1 is hollowed and defines a receiving cavity 11 therein. The receiving cavity 11 has an opening 12 faced upward when the body 1 is standing. A flange 13 is defined around the opening 12 at the top of the body 1. The flange 13 is protruded inward the receiving cavity 11, as shown in FIG. 3. The bottom portion 14 of the body 1 defines an annular groove 15 formed around the same height of the body 1 and recessed inward the body 1, as shown in FIG. 4. The diameter of an upper portion 16 (the portion above the annular groove 15) is greater than the diameter of the opening 12, and the diameter of a lower portion 17 (the portion below the annular groove 15) is less than the diameter of the opening 12. In this embodiment, the outer diameter of the body 1 is gradually reduced from the upper portion 16 toward the lower portion 17. In addition, the body 1 is made of Polyethylene terephthalate (PET).

Figure 5:
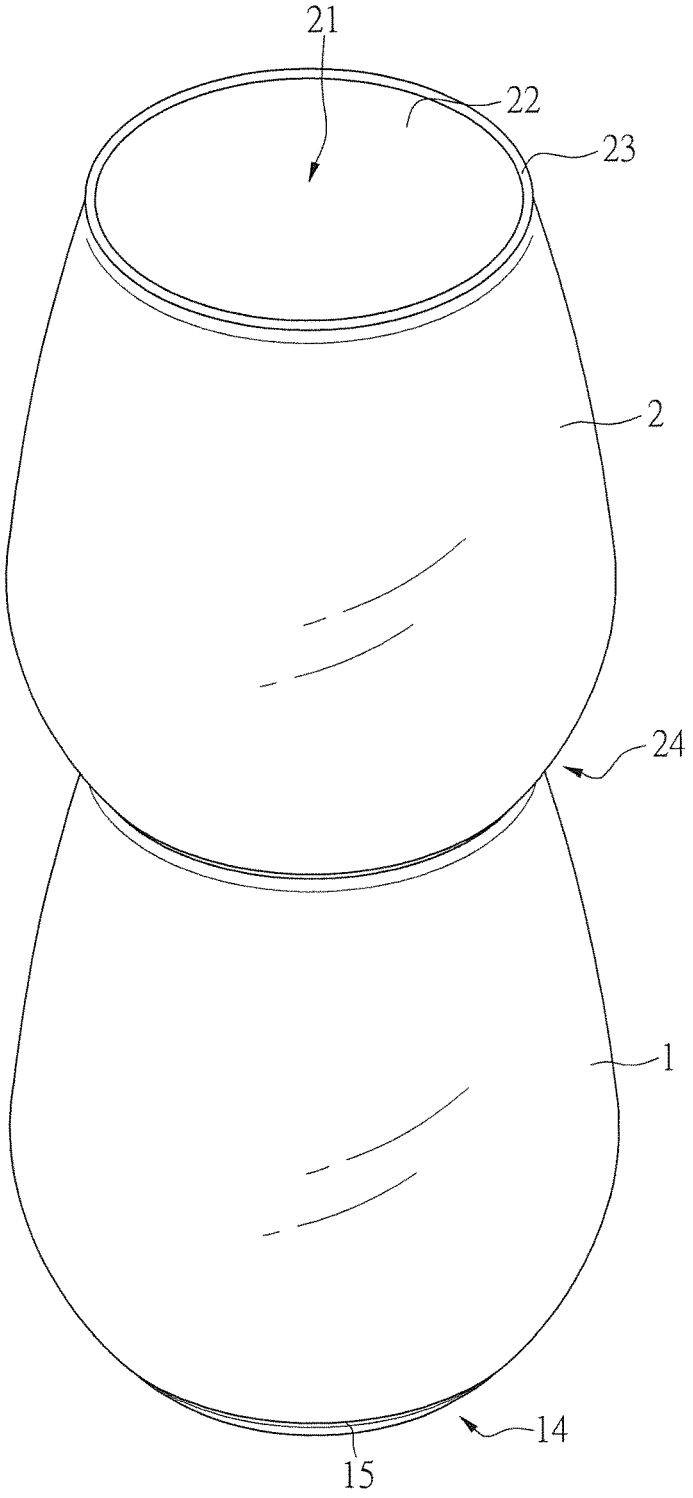
FIG. 5 is a perspective view illustrating that two cups in the first embodiment are stacked with each other.
Figure 6:
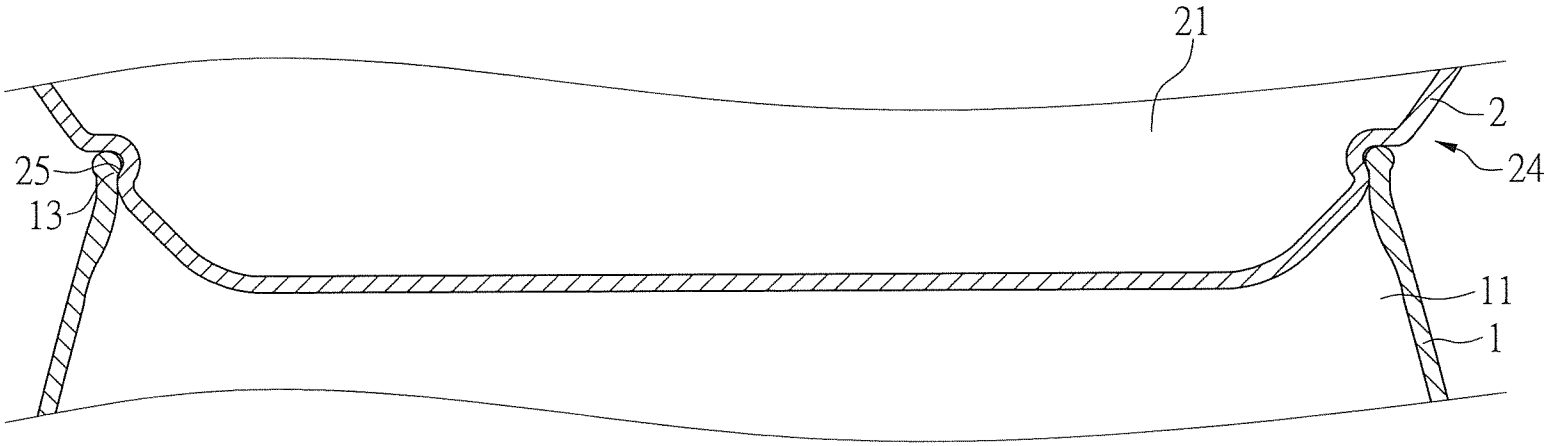
FIG. 6 illustrates a partial enlarged sectional view of the connecting portion of the two cups shown in FIG. 5.

As shown in FIG. 5 and FIG. 6, when the body 1 is to be stacked with a body 2 having a receiving cavity 21, an opening 22, a flange 23, a bottom portion 24, and an annular groove 25. The structure of the body 1 and that of the body 2 are the same. Here, the body 2 is at the top (hereinafter called upper body 2), and the body 1 is at the bottom (hereinafter called lower body 1). In other words, if a user observes the cups along a longitudinal direction, the body 2 is in front of the body 1, and the body 1 is behind the body 2. The lower portion of the upper body 2 is placed into the opening 12 of the lower body 1, and the flange 13 of the lower body 1 is engaged with the annular groove 25 of the upper body 2. Accordingly, two cups of the first embodiment can be stacked with each other.

The advantages of the present invention are described as following. Even though the upper body 2 and the lower body 1 in the first embodiment are tall, and even though the portion (i.e., the lower portion) of the body to be placed into the opening of another body does not take a substantial ratio over the whole body, the cups can be stacked stably through the engagement between the flange 13 and the annular groove 25. Unlike typical cups which are stacked with each other just by fitting over one another, the cups according to the present invention would perform better stability when being stacked one another due to the engaging structure provided to the cup.

Figure 7:
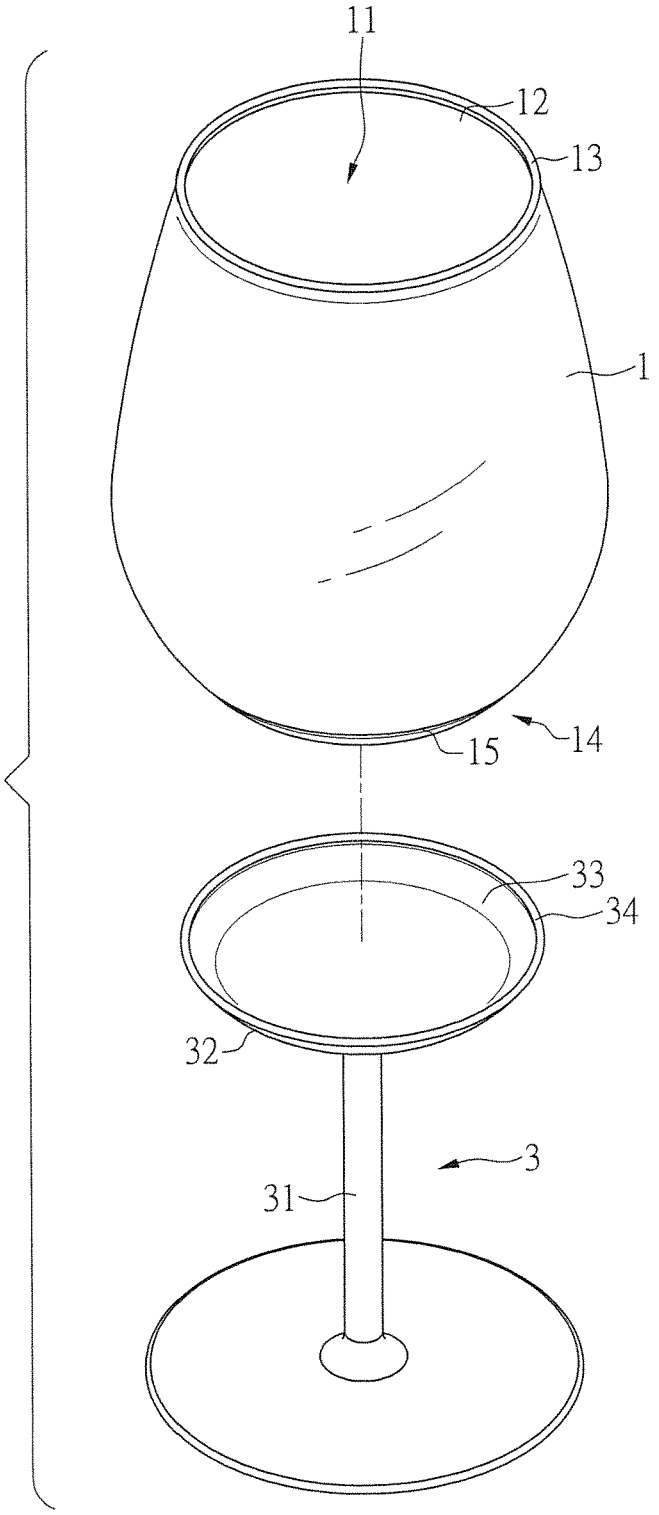
FIG. 7 illustrates an exploded view of a second embodiment of a cup and a cup foot according to the present invention.
Figure 8:
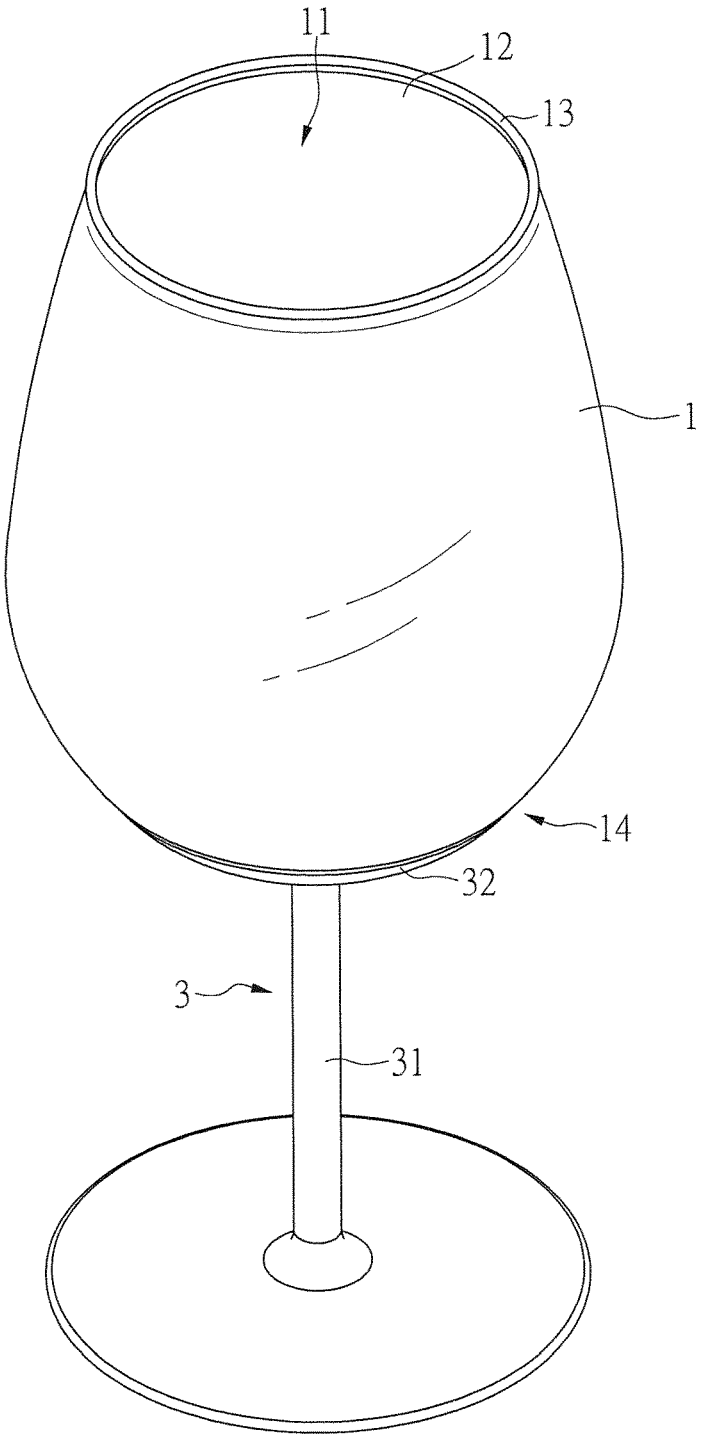
FIG. 8 is a perspective view illustrating that the cup and the cup foot shown in FIG. 7 are combined.

The present invention may have other examples or variations. Please refer to FIG. 7 and FIG. 8, illustrating a second embodiment of the present invention. In this embodiment, the cup comprises the body 1 and a cup foot 3. The cup foot 3 has a foot portion 31, and a base portion 32 is formed at the top of the foot portion 31. The base portion 32 is recessed inward and defines a base opening 33. The structure of the base opening 33 is the same as the structure of the openings 12, 22 of the cups in the first embodiment. A base flange 34 is defined around the base opening 33. The structure of the base flange 34 is the same as the structure of the flanges 13, 23 of the cups in the first embodiment. Accordingly, the lower portion 17 of the body 1 can be placed into the base opening 33 of the base portion 32, and the base flange 34 of the base portion 32 is engaged with the annular groove 15 located at the bottom portion 14 of the body 1. Therefore, the body 1 can be combined with the cup foot 3 to form a goblet, which allows the appearance of the cup can be changed.

Figure 9:
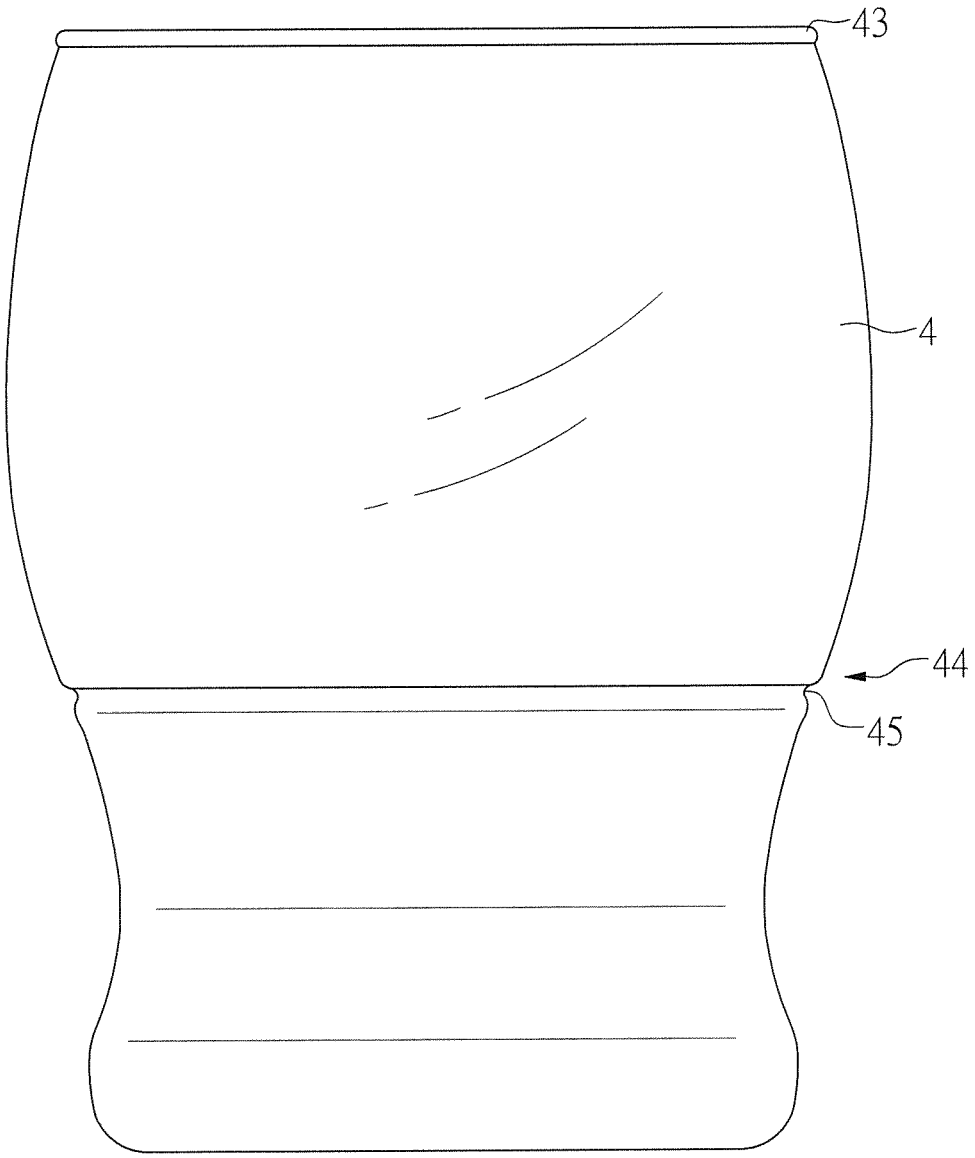
FIG. 9 is a lateral view of a third embodiment of a cup according to the present invention.
Figure 10:
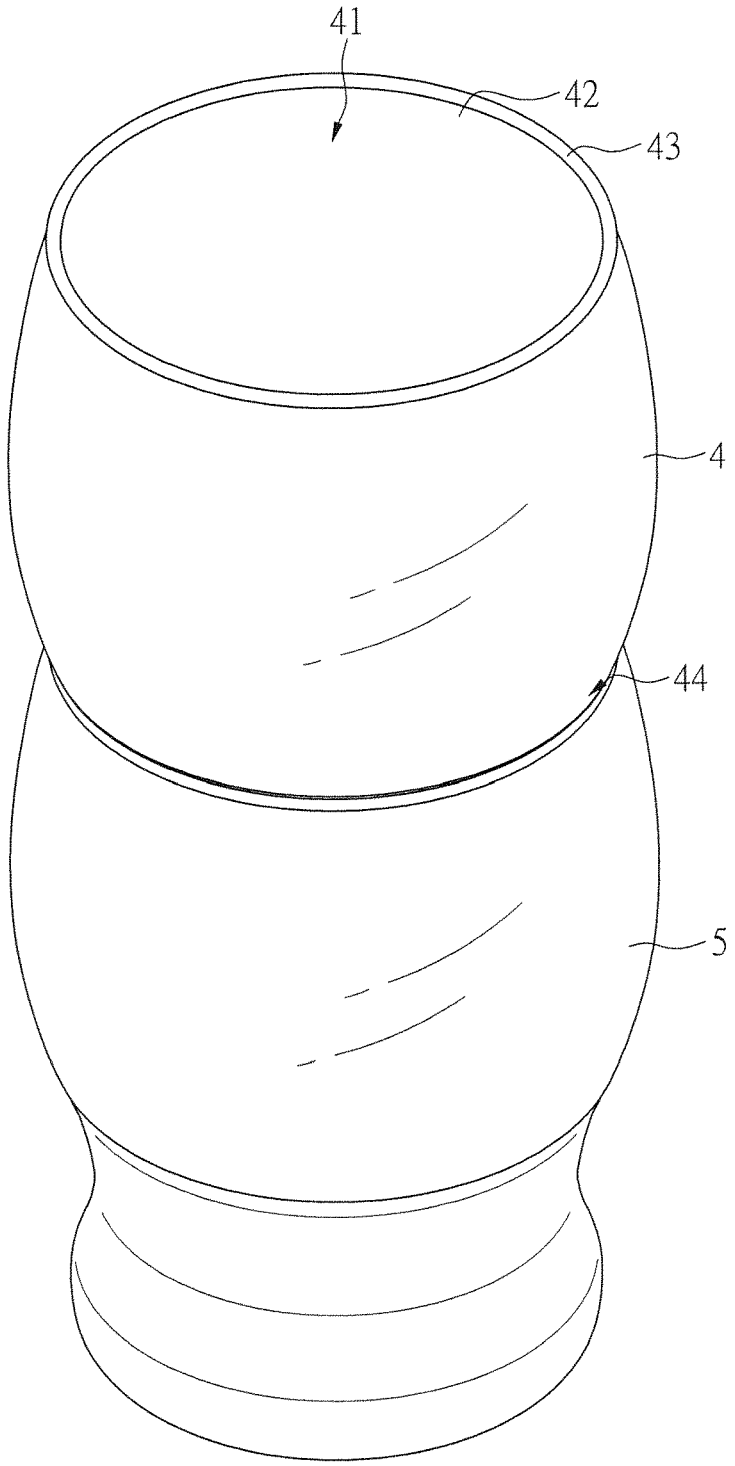
FIG. 10 is a perspective view illustrating that two cups in the third embodiment are stacked with each other.
Figure 11:
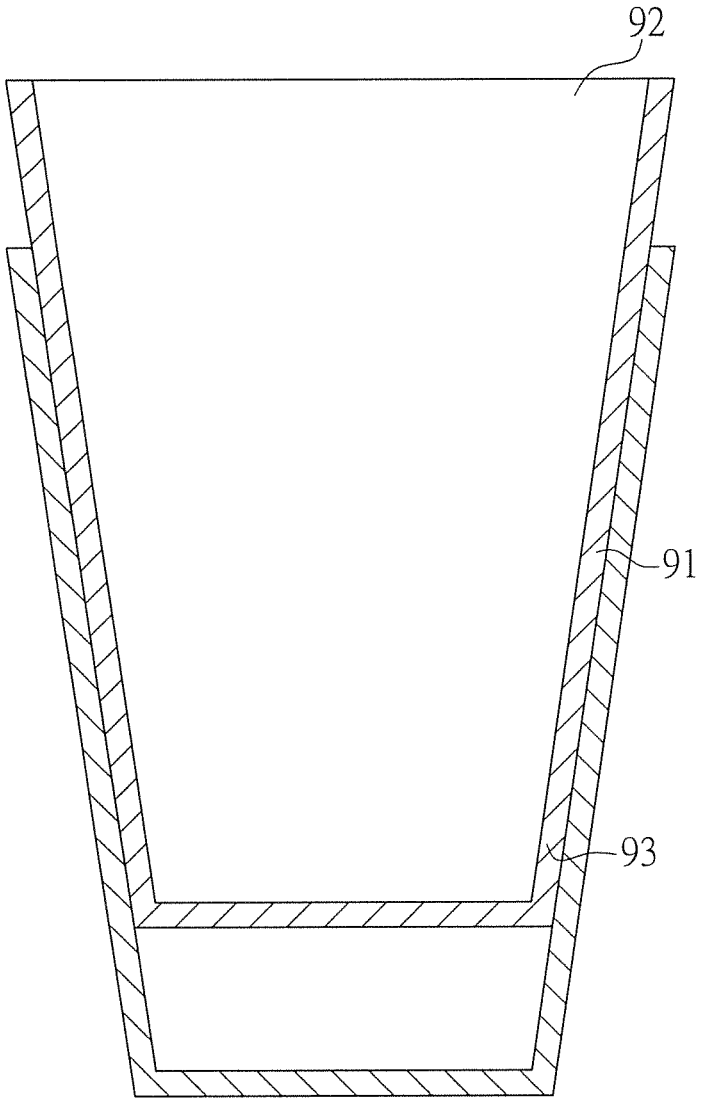
FIG. 11 PRIOR ART
FIG. 11 is a sectional view illustrating that two conventional cups are stacked with each other.
Figure 12:
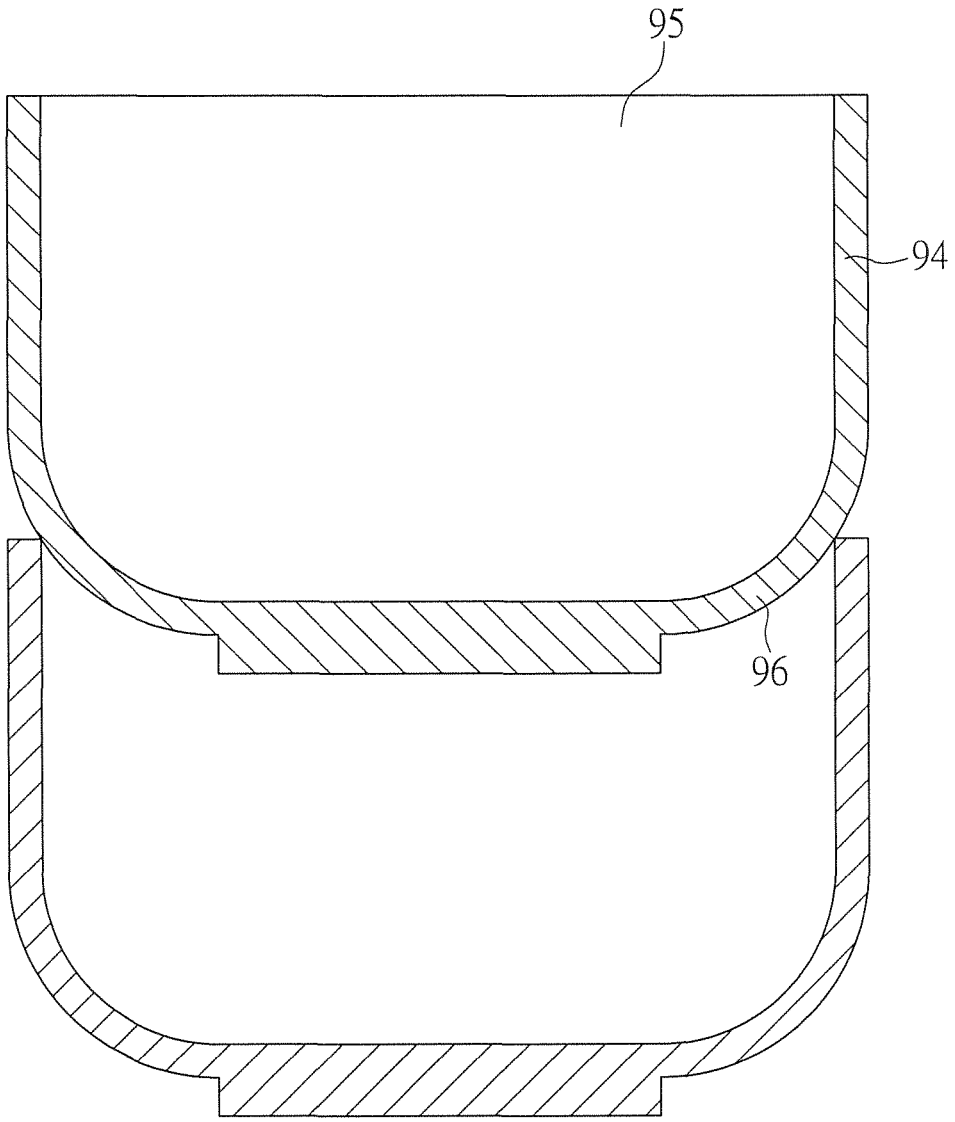
FIG. 12 PRIOR ART
FIG. 12 is a sectional view illustrating that two another conventional cups are stacked with each other.
Figure 13:
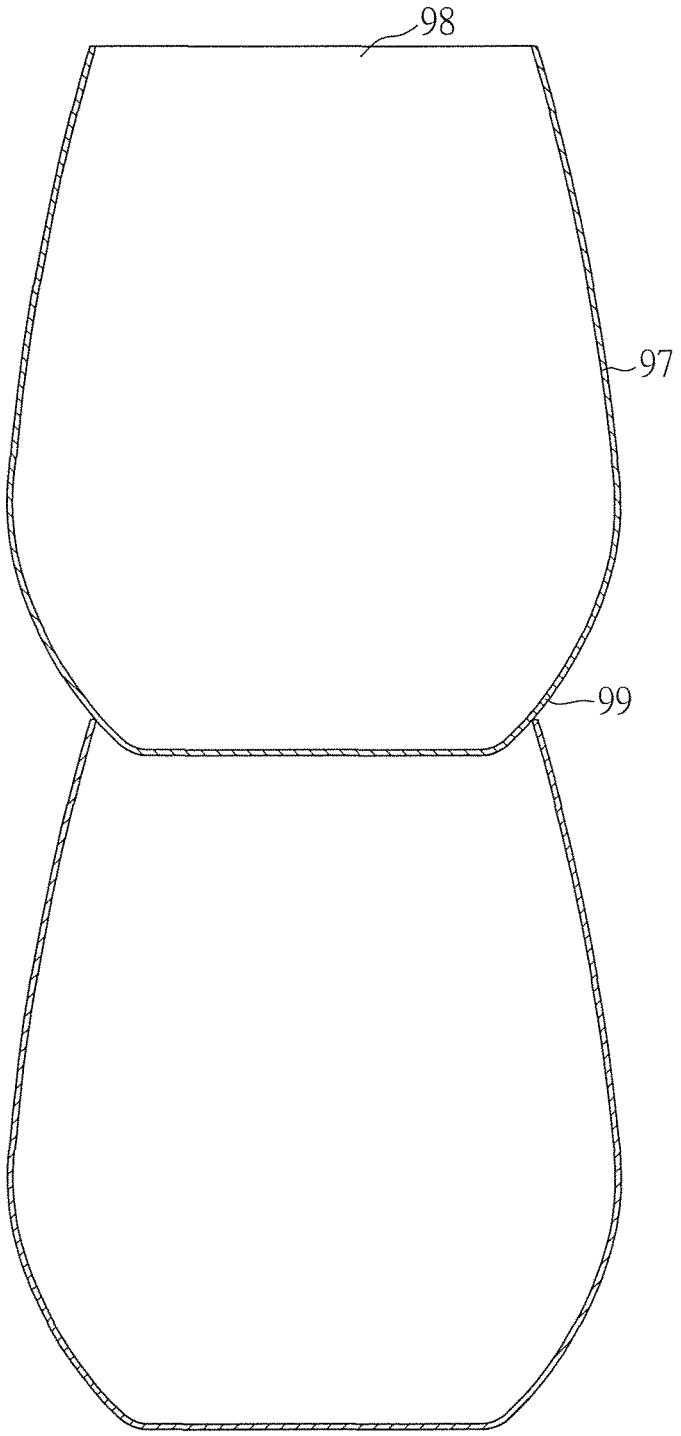
FIG. 13 PRIOR ART
FIG. 13 is a sectional view illustrating that two yet another conventional cups are stacked with each other.

Please refer to FIG. 9 and FIG. 10, illustrating a third embodiment of the present invention. In this embodiment, the cup is a beer mug. In this embodiment, the body 4 of the cup also defines a receiving cavity 41, an opening 42, and a flange 43 formed around the opening 42. The major difference between the third embodiment and the first embodiment is the position where the annular groove is defined at. In the third embodiment, an annular groove 45 is defined at a waist portion 44 of the body 4. In addition, the outer diameter of the body 4 is gradually reduced from the portion above the annular groove 45 toward the portion below the annular groove 45. As shown in FIG. 10, as like the cups shown in the first embodiment, the upper body 4 can be stacked with the lower body 5 in which the lower body 5 has the same structure with the upper body 4.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A cup, comprising: a body, wherein the body having inner and outer wall surfaces, the inner wall surface defining a receiving cavity therein, wherein the receiving cavity has an opening being upwardly facing when the body is standing;

a flange having a bulbous contour and defining an upper edge of the body surrounding the receiving cavity opening, wherein the flange comprises an inward portion, an outward portion and an enlarged portion, the inward portion is protruded radially inward and the outward portion is protruded radially outward thereat relative to a substantially vertical center axis, wherein an inward protruding degree and an outward protruding degree are the same, wherein the enlarged portion is coupled between the inward portion, outward portion and the body, wherein the bulbous flange defines an opening having a diameter less than a diameter of the receiving cavity opening, the body having an annular groove formed into the outer wall surface thereof, the annular groove having a radially innermost surface defining an arcuate sectional contour along an axially directed plane, wherein a portion of the outer wall surface at an upper edge of the annular groove is greater in diameter than the diameter of the receiving cavity opening, and a portion of the outer wall surface at a lower edge of the annular groove is less in diameter. than the diameter of the receiving cavity opening, wherein a diameter of the radially innermost surface of the annular groove is less than both the diameter of the portion of the outer wall surface at the upper edge of the annular groove and the diameter of the portion of the outer wall surface at the lower edge of the annular groove; wherein, when first and second cups are stacked one over the other, a lower portion of an outer wall surface of a body of the first cup is placed into a receiving cavity opening of a body of the second cup, and a bulbous flange of the body of the second cup thereby engages an annular groove of the body of the first cup, wherein the annular groove is defined at a bottom portion of the body, and the body is gradually reduced in outer diameter from an upper portion above the annular groove toward a lower portion below the annular groove; and a cup foot having a foot portion, a base portion and a bottom portion, wherein the base portion is disposed atop the foot portion, the base portion is recessed inward and defines a base opening, and a base flange is defined around the base opening, the structure of the base opening and the base flange respectively corresponding in structure to the receiving cavity opening and the flange of the body, wherein when the cup is to be combined with the cup foot, a lower portion of the body is placed into the base opening of the base portion, and the base flange of the base portion is engaged with the annular groove of the body, wherein the bottom portion is planar, the foot portion is columnar and disposed between the base portion and the bottom portion.

2. The cup according to claim 1, wherein the body is made of Polyethylene terephthalate.

* * * * *